US005168665A

United States Patent [19]

Goldenberg

[11] Patent Number: 5,168,665

[45] Date of Patent: Dec. 8, 1992

[54] TILT SLIDER

[76] Inventor: Shaul Goldenberg, 147 Carrington Drive, Richmond Hill, Ontario, Canada, L4C 7Z1

[21] Appl. No.: 418,212

[22] Filed: Oct. 6, 1989

Related U.S. Application Data

[63] Continuation-in-part of Ser. No. 287,327, Dec. 21, 1988, Pat. No. 4,888,915.

[30] Foreign Application Priority Data

Sep. 14, 1988 [CA] Canada ..... 577393

[51] Int. Cl.[5] ..... E05D 15/22

[52] U.S. Cl. ..... 49/172; 49/181; 188/251 M

[58] Field of Search ..... 49/177, 181, 172, 173, 49/176; 188/251 M; 192/107 M

[56] References Cited

U.S. PATENT DOCUMENTS

| | | | |
|---|---|---|---|
| 4,068,406 | 1/1978 | Wood et al. . | |
| 4,364,199 | 12/1982 | Johnson et al. . | |
| 4,501,347 | 2/1985 | Cerny | 188/251 M |
| 4,718,194 | 1/1988 | Fitzgibbon | 49/181 |
| 4,888,915 | 12/1989 | Goldenberg | 49/181 |

*Primary Examiner*—Kenneth J. Dorner
*Assistant Examiner*—Gerald A. Anderson

[57] ABSTRACT

A pivoting and sliding closure assembly is provided which rides in a guide channel of a frame upon a pivot shoe assembly which at one end securely pivots a closure member upon one pivot shoe when the closure is pivoted away from the channel, and which latches the closure member in a slidable position when the closure member is pivoted to its latched position. The pivot shoes are connnected together in the assembly and unique cam structures and rollers are incorporated in the assembly.

38 Claims, 7 Drawing Sheets

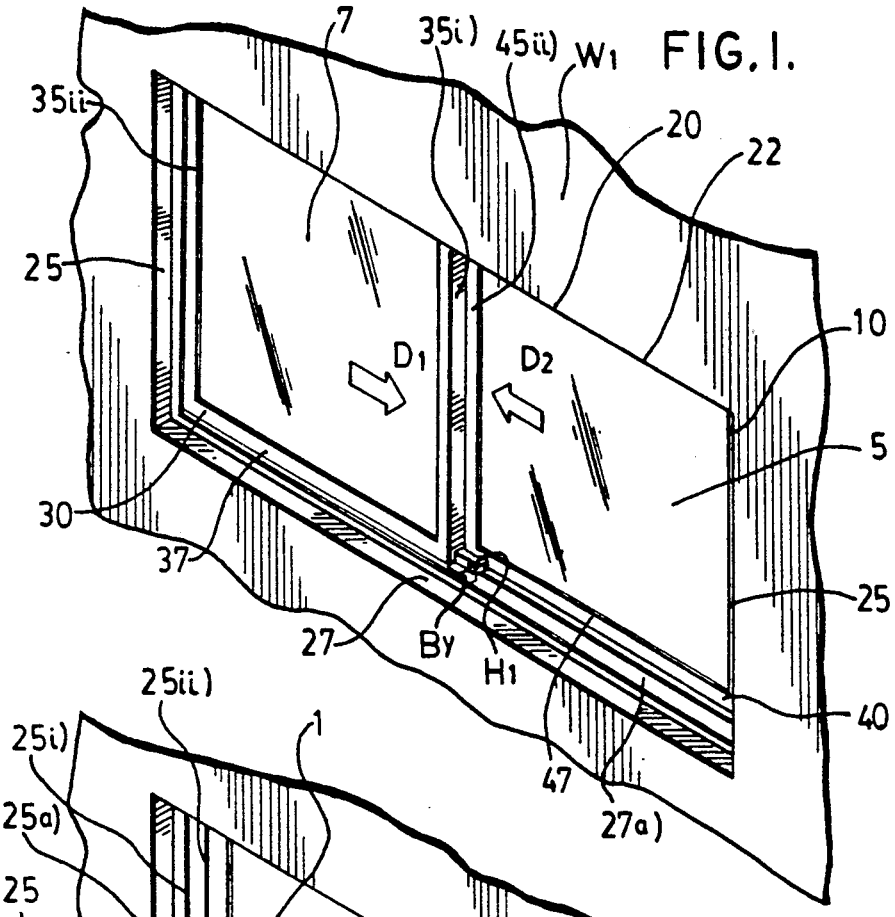
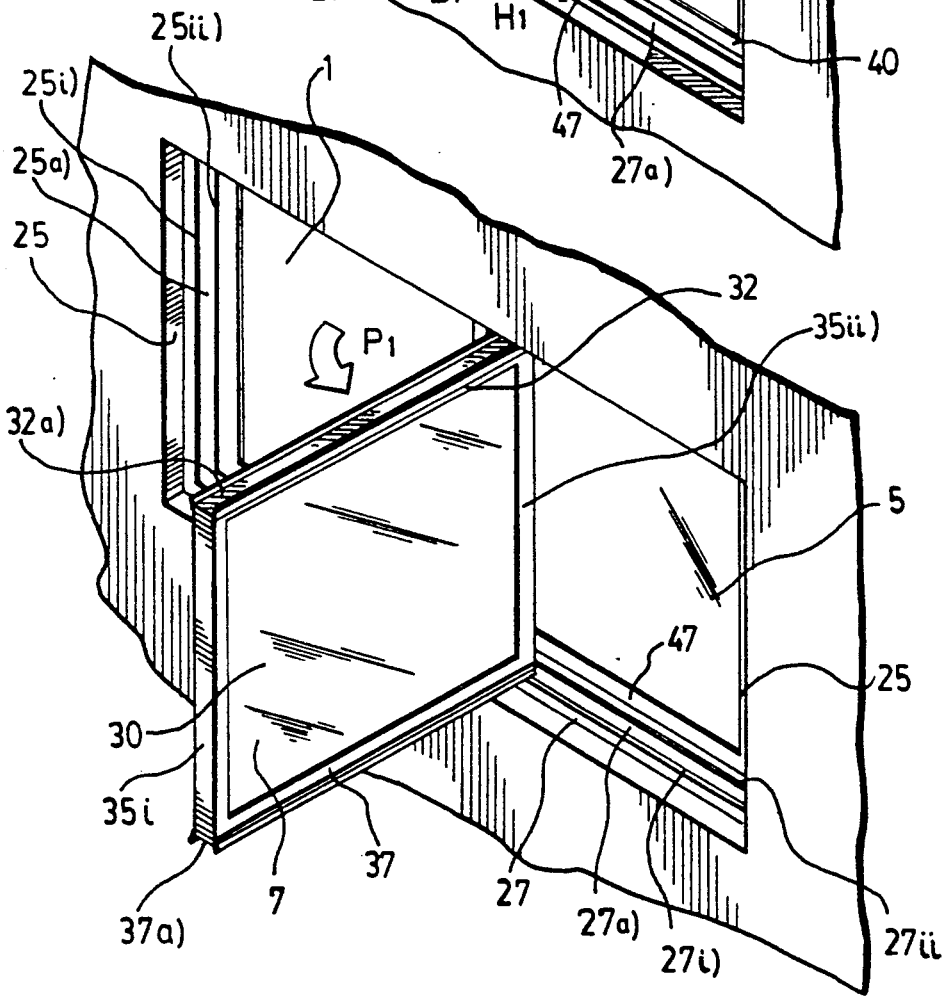
FIG. 2.

TILT SLIDER

This is a continuation-in-part application of copending application Ser. No. 07/287,327, filed Dec. 21, 1988 now U.S. Pat. No. 4,888,915.

FIELD OF INVENTION

This invention relates to devices which allow the sliding and subsequent pivoting of a closure member from a locked position wherein in sliding of the closure member is allowed to a fully pivoted position where sliding of the member is prohibited. The invention is preferably embodied in a tilt slide window assembly.

BACKGROUND OF THE INVENTION

Double hung windows are well known in the art. There are a multiplicity of examples of such double hung windows which incorporate window frames and jamb guides located therein for the sliding of a window sash within the jamb guide. Further there are many examples within the prior art which allow for the sliding of a window sash within a frame within the jamb channels thereof which further incorporate a carrier or shoe attached to the window sash which allows for the pivoting of the window sash away from the window frame.

U.S. Pat. No. 4,610,108 describes such a device which incorporates a generally U-shaped spring member within a block, wherein a pin or strut extending from the windows sash is connected. A cam member is incorporated in the block member which is rotatably engagable with the U-shaped member to lock the block in position.

Another example of such a tiltable window sash is found in U.S. Pat. No. 3,844,066 wherein the block is further attached through the sash balance. The cam is incorporated in the block and a pin or strut is attached thereto for rotational pivoting of the window sash and the subsequent locking of the block in position.

U.S. Pat. No. 4,364,199 describes a similar type block as described above incorporated in a window jamb weather strip, whereby the slidable block is held fixedly in place with respect to the weather strut.

U.S. Pat. No. 4,718,194 describes a shoe or block for pivoting a sash and allowing the sliding thereof as well within the window jamb channel, wherein the window may be removed from the assembly while the lock and balance remain in place. This allows the insertion of the window when repaired without the nuisance and deterioration of the movement of the sash and block. Another example of an alternative structure which illustrates the multiplicity of cams and block assemblies found within the prior art is found with U.S. Pat. No. 4,683,676. The aforementioned reference describes a split shoe having a cam and stud or pivot assembly which allows for the ease of repair of the pivot block and portions thereof without providing for a special feature within a jamb channel of a window frame.

Canadian Patent 1,195,186 describes a typical shoe and sash assembly incorporating a spring member for gripping to the jamb channel when the cam is rotated. U.S. Pat. Nos. 3,146,501, 3,462,882, 3,184,784 and 3,055,062 illustrate alternative cam devices used within window frames.

U.K. Patent Application 2,083,118 describes a window assembly incorporating a pair of wheels within a sash frame to allow for the sash frame to more easily slide within the jamb channel.

U.S. Pat. No. 3,842,540 describes a two part cam and locking structure which attaches into the sash portions of the window assembly and allows for the pivoting and locking of a window assembly. However, the structure is not embodied to easily access the locking portion, being attached to the balance sash as best illustrated in the FIGS. 6 through 9 of the aforementioned Patent. When the window sash is pivoted away from the frame the handle portion does not disengage the window sash but provides for locking portions to lock the sash in a predetermined vertical position during tilting thereof.

Further within the prior art a tilt slider is manufactured and distributed by Canadian Thermo Windows, whose office is in Toronto, Canada, which provides sash assemblies and pivots therefor for sliding in a horizontal direction. A shoe or block is provided to allow for the sliding of the windows within a channel within the header and sill sections of the window frame. Pins extend from the block or shoe into the sash at the top and bottom of each window sash. The pins, pivot or struts as they are known in the art extend into a cam member which is rotatable when the sash is rotated in a direction away from the window frame and thus allows for the locking of the window frame in position. There is further incorporated in the shoe design a fastening device to fasten the pin or strut extending into the cam into the shoe or block to prevent the pin and hence window from falling out of the cam should the sash have a tendency under its weight to load the cam pin. It has been typically a problem to the operation of the window assembly to ensure the easy movement thereof and prevent the window sash from sagging when it is moved. It has been found that in operation the window sash will not always return to the same location for locking in that the, for example, top block or shoe may be advanced in position when the window is sagged and returned from its pivoted position and thus an opening to allow air to pass through may occur at the edge of the window when closed. Further the window incorporates latching means to latch the window in position for security purposes. Further locking means are provided which incorporate tongues which extend in a vertical position into the header and sill channels to prevent the window from pivoting and allow when unlocked to pivot the window. However such devices are typically recessed into the window sash at the edge thereof and are often difficult to operate.

Further within the prior art the aforementioned problems described above will generally occur when any pivot block provided on the edge of the window sash moves in relation to another pivot block. The only means for securing the sash of the window to the pivot block being either a pin or strut. The continuing motion and sliding of the windows back and forth and the pivoting thereof causes the windows to misalign and sag under the weight of gravity especially when manufactured in a vertical tilt slider. In order to overcome this problem an improved bracing system is sadly lacking within the prior art.

A multiplicity of designs for sliding patio doors further exist within the prior art. A typical patio door is made up of two framed main glass panels sliding in a horizontal direction but which do not typically pivot. The weight of the patio doors would require a substantial device in order to allow for the pivoting thereof, such hardware would further eliminate or minimize the door sagging out of position and the need for realignment of the doors when pivoted back to the closed position. The pivoting of patio doors would be quite attractive and would allow for the incorporation of French type doors in the industry. No such doors exist within the market place at the present time.

It is therefore an object of this invention to overcome all of the deficiencies in the prior art stated above which allows for smooth operation of a closure member which is capable of both sliding within a guide channel and tilting upon a pivot assembly thereof. Nowhere within the prior art is such a device provided which allow for the manufacture of heavier windows in larger sections without the sagging of the window and having reliable operating pivots incorporated in the block members which both allow for the pivoting and locking of the window by the user.

It is a further object of the invention to provide a reliable pivot shoe for use in relation to a guide channel disposed within a frame for a closure member whereby locking of the pivot shoe occurs almost immediately when the window or closure member is rotated.

It is a further object of this invention to provide a pivot shoe assembly which is interconnected to allow for the bracing of the closure member and the prevention of sag thereof.

Further and other objects of this invention will become apparent to a man skilled in the art when considering the following summary of the invention and the more detailed description of the preferred embodiments illustrated herein.

SUMMARY OF THE INVENTION

According to one aspect of the invention, there is provided a pivoting and sliding closure assembly comprising:

i) an opening extending in a peripheral frame said peripheral frame including a header portion, a sill portion and two vertically extending jamb portions ii) the sill and header portions or the two jamb portions having disposed therein or attached thereto track portions extending in a substantially parallel direction to the extensions of said peripheral frame portions ii) a) at least one closure member slidable within said track portions and pivotable proximate at least one end thereof and latchable proximate the other end thereof iii) each track portions having disposed therein at least two pivot shoes being interconnected by interconnecting means, each pivot shoe including a preferably substantially rectangular shaped carrier portion, the carrier preferably having rolling means disposed therein for assisting the movement of the pivot shoe, the carrier further having interconnecting portions therewith to interconnect with the interconnecting means (preferably lockable interconnecting means lockable in relation to said carrier) some of the carrier portions having disposed therein an opening wherein camming means are disposed, said camming means being moveable to cause locking means disposed with said pivot shoe to engage and lock the pivot shoe from sliding movement in the track portions iv) some of the camming means of some of the pivot shoes having engagement means therewith for engagement with pivot means of the at least one closure member to allow the at least one closure member to rotate when free to do so and upon rotation thereof to cause the camming means to rotate thus locking the locking means of the pivot shoe v) some of the camming means of some of pivot shoes having latching means engaged therewith for latching the at least one closure member having latch engaging means therewith to prevent the closure member from pivoting upon its pivot means when the closure member remains slidable with said track and which when disengaged locks the pivot shoe in position with respect to the track by engaging the locking means thereof vi) the at least one closure member being braced from sagging by the interconnecting means interconnecting the pivot shoes disposed in each track, the interconnecting means further preventing the pivot means from disengaging from the relevant pivot shoe when the at least one closure member is rotated to an open position.

According to another aspect of the invention, there is provided a pivoting and sliding window assembly comprising:

i) an opening extending in a peripheral frame said peripheral frame including a header portion, a sill portion and two vertically extending jamb portions ii) the sill and header portions or the two jamb portions having disposed therein or attached thereto track portions extending in a substantially parallel direction to the extensions of said peripheral frame portions ii) a) at least one window sash slidable within said track portions and pivotable proximate at least one end thereof and latchable proximate the other end thereof iii) each track portions having disposed therein at least two pivot shoes being interconnect by interconnecting means, each pivot shoe including a preferably substantially rectangular shaped carrier portion, the carrier preferably having rolling means disposed therein for assisting the movement of the pivot shoe, the carrier further having interconnecting portions therein to interconnect with the interconnecting means (preferably lockable interconnecting means lockable in relation to said carrier) some of the carrier portions having disposed therein an opening wherein camming means are disposed, said camming means being moveable to cause locking means disposed with said pivot shoe to engage and lock the pivot shoe from sliding movement in the track portions iv) some of the camming means of some of the pivot shoes having engagement means therewith for engagement with pivot means of the at least one window sash to allow the at least one window sash to rotate when free to do so and upon rotation thereof to cause the camming means to rotate thus locking the locking means of the pivot shoe v) some of the camming means of some of pivot shoes having latching means engaged therewith for latching the window sash having latch engaging means therewith to prevent the at least one window sash from pivoting upon its pivot means when the closure member remains slidable with said track and which when disengaged locks the pivot shoe in position with respect to the track by engaging the locking means thereof vi) the at least one window sash being braced from sagging by the interconnecting means interconnecting the pivot shoes disposed in each track, the interconnecting means further preventing the pivot means from disengaging from the relevant pivot shoe when the window sash is rotated to an open position.

According to yet another aspect of the invention there is provided for use in a pivoting and sliding closure assembly, a closure member (preferably a window sash) slidable within a guiding channel having outwardly extending flanges and pivotable therefrom, the closure member having a substantially rectangular frame having a top and bottom, and having engaged at its top and bottom proximate one end pivot means for engaging a first and second pivot shoe, and having disposed proximate the other end thereof proximate the top and bottom means for engaging a third and fourth pivot shoe, said pivot shoes slidable in said guiding channel and comprising a body having a top and bottom (preferably made from thermoplastic material) and having disposed proximate the bottom thereof at least one roller or wheel, said pivot shoes having disposed proximate one end thereof fastening means to fasten at least the first and third, and the second and fourth pivot shoes together by connecting means extending therebetween (preferably the connecting means being adjustable in length), each pivot shoe having a slot disposed proximate the end thereof remote the fastening means, said slot including an opening therein for a cam member, said slot and opening extending from proximate the top to proximate the bottom of said pivot shoe, said cam member being substantially cylindrical having a central axis and having camming means thereupon or upon the perimeter of the opening of said slot wherein a detent extends with said cam for engagement with the pivot means connected to the closure member for the first and second pivot shoe and a handle member for the third and fourth pivot shoe, said handle member having engagement means thereupon for engagement with the means for engaging the third and fourth pivot shoe of the closure member, the body having two legs, one on each side of the slot, having a clamping surface upon the surface of the body adjacent the outwardly extending flanges of the guide channel;

whereby when the handle member of the third and fourth pivot shoes are rotated the pivot means and the cam member rotate, and the two legs of the body move laterally away from the cam member urged by the camming means, the clamping surface thus engages the outwardly extending flanges of the guide channel thus locking the third and fourth pivot shoes in position in relation to said first and second pivot shoes, however rotation of the handle member disengages the means for engaging the third and fourth pivot shoes and the closure member, allowing the pivoting of the closure member upon the first and second pivot shoes upon the pivot means away from the guide channel, the closure member when pivoted causes the cam member of the first and second pivot shoe to rotate wherein the first and second pivot shoes are locked in position in the guide channel in identical manner to the third and fourth pivot shoe further prevented from movement under the weight of the closure member by the third and fourth pivot shoes locked and interconnected to the first and second pivot shoes.

According to yet another aspect of the invention the assembly may comprise third and fourth pivot blocks whose handles extend in a substantially horizontal direction from the extension of the vertical extending pivot pins when the guide channel in which the first and third pivot shoe and the guide channel in which the second and fourth pivot shoes are vertically displaced a predetermined amount to allow pivoting of the window.

According to yet another aspect of the invention the closure member and the preferable window sash may further comprise weather stripping portions extending from the top and bottom thereof.

According to yet another aspect of the invention the cam member having further comprise locking means to lock the pivot pins within cam opening.

According to yet another aspect of the invention the cam member may further comprise recesses upon the surface thereof in alignment with beads upon the perimeter of the opening of the slot of the rectangular body, whereby the recesses and beads when aligned allow sliding movement of the shoe, wherein when not aligned cause the legs to move and cause the locking surfaces to engage the flanges of the guide channel.

According to yet another aspect of the invention the closure assembly may comprise patio doors.

According to still yet another aspect of the invention the handles may further comprise keyed locking means.

According to yet another aspect of the invention a pivot shoe for connection to a pivotable and slidable closure member (preferably a window sash) is provided for movement in a guiding channel having outwardly extending flanges, the pivot shoe comprising a body having a top and bottom and two ends (preferably formed from thermoplastic materials), said body having disposed at one end thereof an opening being generally cylindrical in shape, the body having disposed upon the perimeter of the opening at least one bead (preferably laterally opposed) extending towards the center of the opening, the opening having a cam member disposed therein engageable with the closure member and having disposed upon its perimeter at least one recess (preferably laterally opposed) compatibly shaped with and for engagement with the at least one bead of the opening, the cam for engaging clamping means disposed with said pivot shoe for clamping against the outwardly extending flanges of the guide channel when at least one recess of the cam moves from a position wherein it is aligned with the at least one bead of the body disposed proximate said opening, to a position wherein it is not aligned with said bead.

According to yet another aspect of the invention the pivot shoe may further comprise roller means to improve the sliding movement thereof in the guiding channel.

According to yet another aspect of the invention each pivot shoe may further comprise fastening means to fasten more than one pivot shoes together. Preferably each body having an opening on the top thereof remote the cam for accepting a screw fastener. Preferably the fastening means being adjustable.

According to yet another aspect of the invention the roller means may further comprise at least one roller having a central axis and having mounting pins extending from the ends thereof preferably for insertion within an opening within said body proximate the bottom thereof, the opening for said mounting pins being tapered from bottom to top wherein the narrowed portion is of less width than the diameter of the mounting pins, the narrow taper having an arcuate portion above it to retain the mounting pins in position in use.

According to yet another aspect of the invention the pivot shoe may further comprise clamping means extending wherein the clamping means are two legs of the body proximate the opening created by a slot extending from proximate the top to proximate the bottom of the body and substantially bisecting the openings, each leg by movable into clamping engagement with the outwardly extending flanges of the guiding channel when the cam is pivoted.

According to a further aspect of the invention the assembly may comprise a carrier wherein the locking means of the pivot shoe further comprises braking surfaces affixed to the pivot shoe to engage the track portions of the closure assembly. In a preferred embodiment the braking surfaces further comprises preferably metal inserts having pebbled surfaces.

In yet another aspect of the invention there is provided for a closure assembly a pivot shoe having an opening therewith moveable in track portions of the closure assembly, the pivot shoe having camming means disposed in the opening, locking means disposed with the pivot shoe for engagement with track portion of the closure assembly, the locking means having braking surfaces therewith to engage the track portions of the closure assembly. In a preferred embodiment the braking surfaces further comprises inserts affixed to the pivot shoe. Preferably the inserts have a pebbled preferably metallic surface.

BRIEF DESCRIPTION OF THE DRAWINGS

FIG. 1 is a perspective view of a tilt sliding window assembly illustrated in a preferred embodiment of the invention.

FIG. 2 is a similar view to that of FIG. 1, illustrating the movement of the sash of the window assembly in a preferred embodiment of the invention.

DETAILED DESCRIPTION OF THE PREFERRED EMBODIMENTS

Figure 7A:
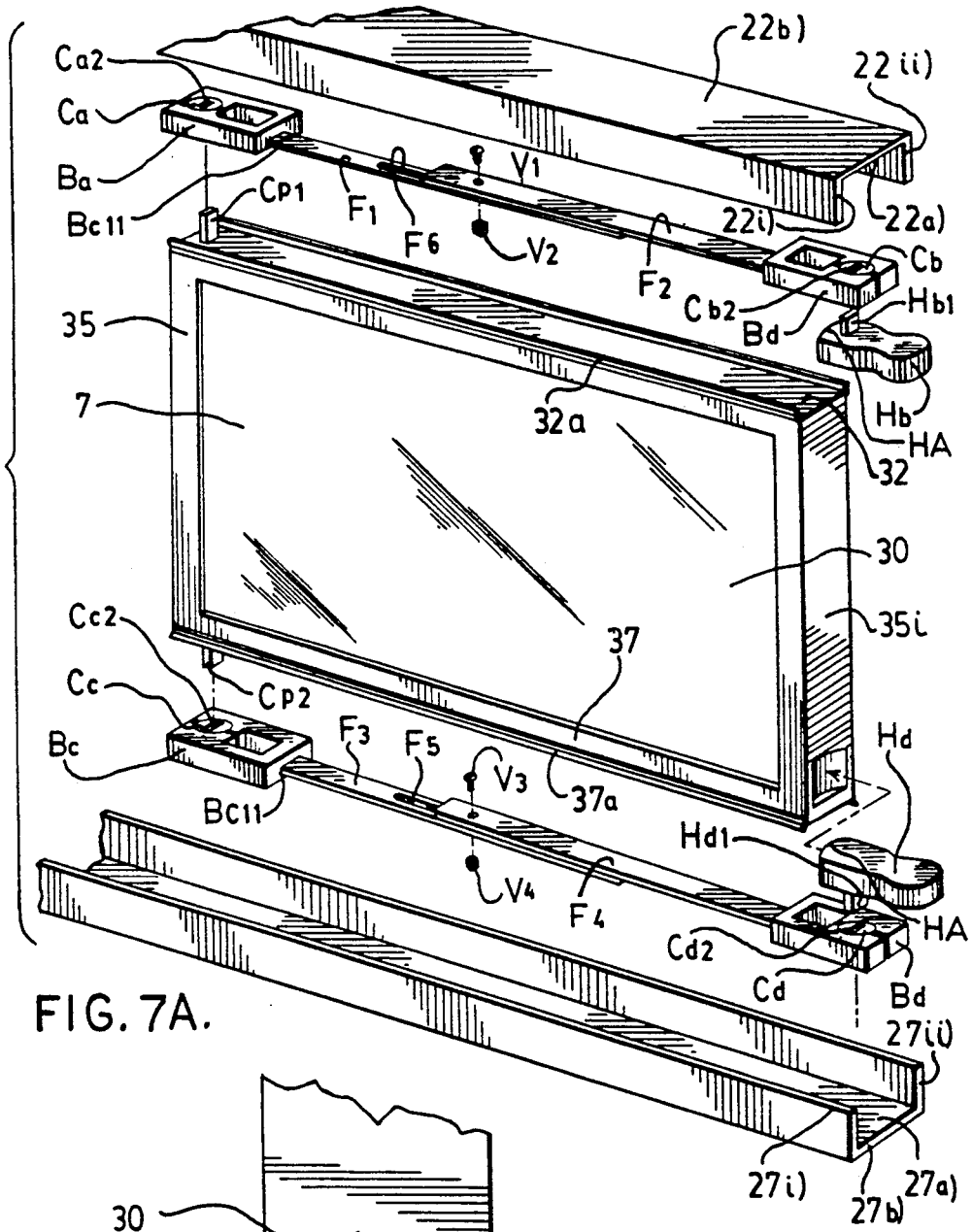
FIG. 7*a* is a exploded perspective view of the sash 30 of FIG. 1 illustrating the operating components thereof in a preferred embodiment of the invention.

Referring now to FIG. 1, there is illustrated a wall W1 having an opening therein within which a window assembly 10 is contained. The window assembly 10 is made up of a peripheral frame 20 having a header portion 22 and a sill portion 27 interconnected by vertical stiles 25. Disposed upon the header section 22 and the footer section 27 are track or channel portions 27*a* and 22*a* not shown. Window sash elements 30 and 40 are slidably received within the track portions 27*a* and 22*a* respectively. The sash elements 30 and 40 slide in directions D1 and D2 respectively from open to closed positions as is known in the art. However, at the corners of each window assembly, as best illustrated in relation to FIG. 7*a* are disposed carrier mechanisms, such as By found in FIG. 1 which offer unique features which allow the window to both slide in the directions D1 and D2 and to pivot in a direction laterally away from the window frame 20.

The sash element 30 is made up of horizontally extending members 37 and 27 and vertically extending members 35*i* and 35*ii*. Window sash element 40 is comprised of horizontally extending elements 47 and 42 and vertically extending elements 45*i* and 45*ii*.

The block or carrier mechanism By has a handle disposed thereupon H1 which allow the window to be locked in position in its sliding mode the details which will be described hereinafter.

Referring now to FIG. 2, there is illustrated the identical window assembly of FIG. 1 with all of the components thereof, wherein the window sash 30 has moved from its position proximate the frame member 25*a* to a position wherein the opening 1, normally covered by a screen allows the passage of air from the outside environment. The handle H1 has been rotated as illustrated in relation to FIG. 6*c* and 6*d* to allow for the pivoting of a sash 30 in a direction P1 to allow for the cleaning of the window pane 7 on both side thereof. A window normally has a tendency to sag when held in the position illustrated in FIG. 2, however, because of a unique bracing system, as illustrated in FIG. 7*a* the window remains firmly locked and supported in the position illustrated in FIG. 2. The details of such mechanism will be described hereinafter.

Figure 3:
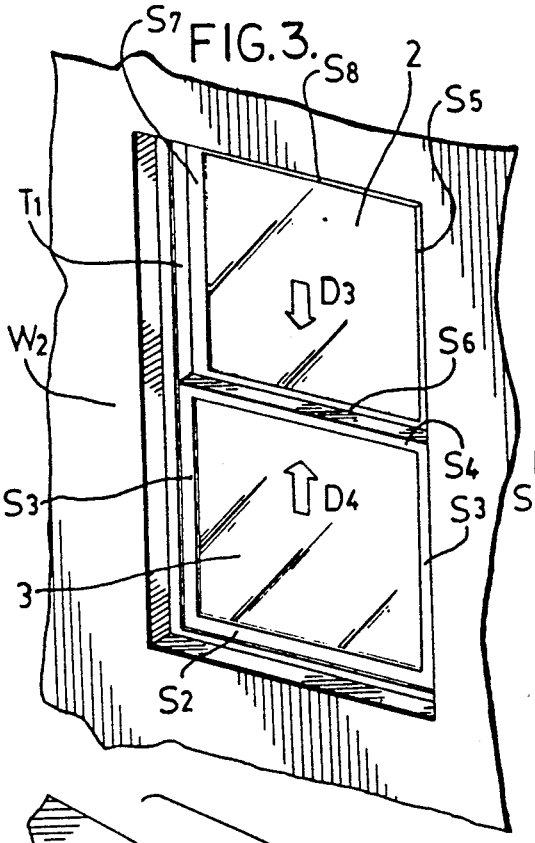
FIG. 3 is a perspective view of a double hung window assembly illustrated in an alternative embodiment of the invention.
Figure 4:
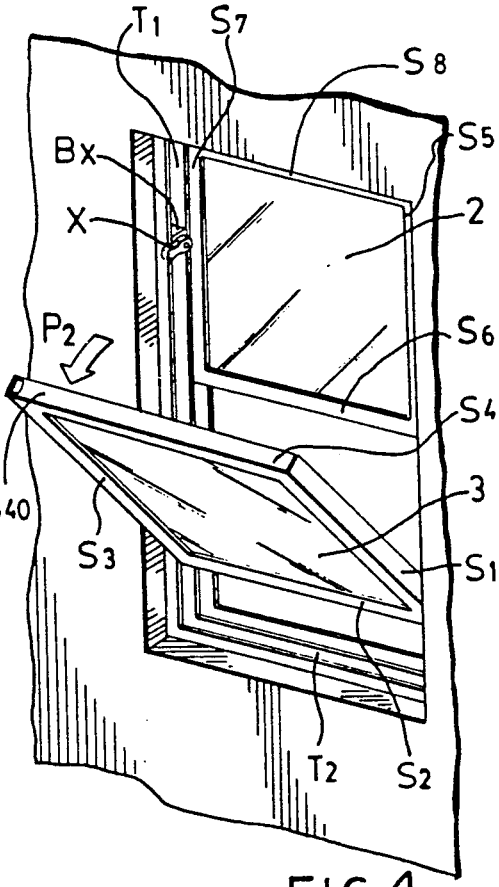
FIG. 4 is a view similar to that of FIG. 3, illustrating the movement of the sash portion of the window assembly in an alternative embodiment of the invention.

Referring now to FIGS. 3 and 4, there is illustrated a double hung tilting window assembly, wherein sash elements 2 and 3 are supported on a track T1 extending in a generally vertical direction for sliding of the sashes 2 and 3 therein. For purposes of illustration, all track elements extending vertically are entitled T1. The window sashes 2 and 3 can move in directions D4 and D3, within a multiplicity T1, two each for each window, extending substantially vertically. Each stile 2 and 3 are composed of sections S1, S2, S3, S4, S5, S6, S7, and S8 respectively as is known in the art. However, a block Bx as best illustrated in relation to FIG. 6*c* and 6*d* is provided to allow the pivoting of the window sash 3 in a direction P2 allow the cleaning thereof while ensuring the firm support of the window and the placement of the block Bx within guide channel S40 disposed within member S4. Further illustrated in FIG. 4 are track portions T2 disposed in a general horizontal direction as is known in the art. The block Bx may be conveniently attached to the sash balance of a double hung window in order to ensure the operation of the mechanism. As illustrated in FIG. 7*a* the block or carrier Bx would be connected to the pivoting member or carrier at the end of the sash 3, wherein horizontally extending portions S2 are disposed. Thus, although the window is pivoted to a position laterally away from its normal sliding position, it is fully supported by a unique structure held within the tracts T1 and locked therein which will be described hereinafter.

Thus, we see that the instant invention has application to sliding windows whether it be the sliding assembly illustrated in FIG. 1 or the sliding assembly illustrated in FIG. 2. The advantages of the invention may still be realized in either embodiment.

Figure 5:
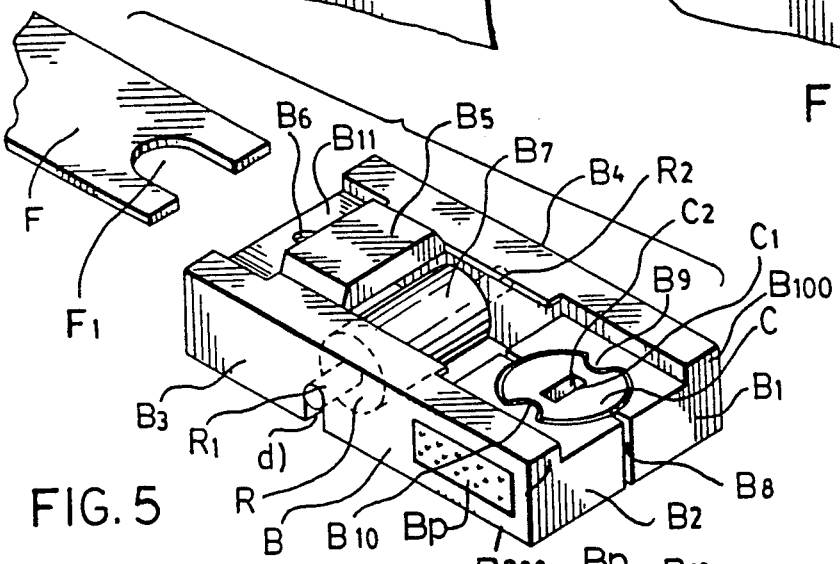
FIG. 5 is a perspective view of a carrier mechanism of a preferred embodiment of the invention illustrating the components thereof.
Figure 6:
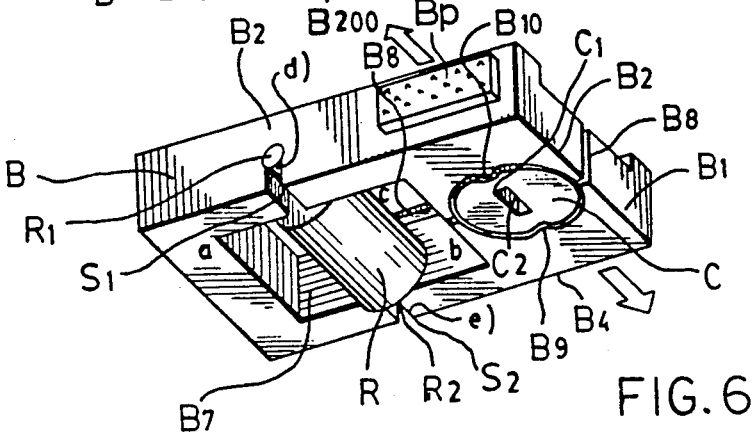
FIG. 6 is a perspective bottom view of the carrier mechanism of FIG. 5 in a preferred embodiment of the invention.

Referring now to FIG. 5 and FIG. 6, there is illustrated in perspective and bottom perspective views respectively a typical carrier mechanism of the block of a preferred embodiment of the invention. A thermoplastic guide member B is moulded or formed from thermoplastic materials having a top and bottom and two ends, having disposed at one end thereof at the top thereof the fastening element B5 for interconnecting flat rod F via a notch or recess F1 which will engage with a threaded opening B6 upon a cut out section B11 on the top of the block or carrier B. Of course it is understood that at the other end of the flat rod F, exists another block or carrier mechanism which is clearly illustrated in FIG. 7*a*. The notch F1 may merely be a hole in another embodiment. Located at the other end of the block B extending from top to bottom of a carrier mechanism is a cam portion C having cut out portions C1 disposed on each side thereof facing the track engaging portions B3 and B4 of the block B. Within the cam C is further disposed an opening of generally rectangular shape C2, within which a pin or pivot will extend in order to support the pivoting of the window frame or sash the details of which will be described hereinafter. Located adjacent the recesses C1 of cam C are disposed horizontally extending beads B9 and B10 which extend inwardly towards the center of the cam and extending in a direction of the width of the block B. A slot B8 is located within the block B extending from top to bottom which essentially bisects the opening (not illustrated) within which the cam C rides. The slot B8, thus bisects the front portion of the block B into two legs, B1 and B2 remote the flat bar F. Extending upwardly away from the block B are shoulders B100 and B200 which extend along the length of the block mechanism B and further provide the slot or recess into which the flat bar F will engage. An opening B7 is disposed upon the bottom of the carrier B and the intersection of the opening proximate the top provides for a slot proximate the fastening opening B6 within which the flat bar F is connected. Disposed within the opening is a roller R being supported by extension portions of generally tubular form R1 and R2 which fit within slots S1 and S2 formed upon the bottom of the block B proximate the sidewalls B3 and B4. The opening B7 is formed with peripheral walls A and B and having a top C which is defined as the bottom of a portion B5. The roller is provided for improving the movement of the block within a track or guide channel of a jamb, sill or header.

As is illustrated in relation to FIGS. 6*a* through 6*d*, the cam C may contain a pivot pin connected to either a window sash or a handle. The details of the operation of the carrier or block B will now be described in relation to FIGS. 6*a* through 6*d*.

Figure 6A:
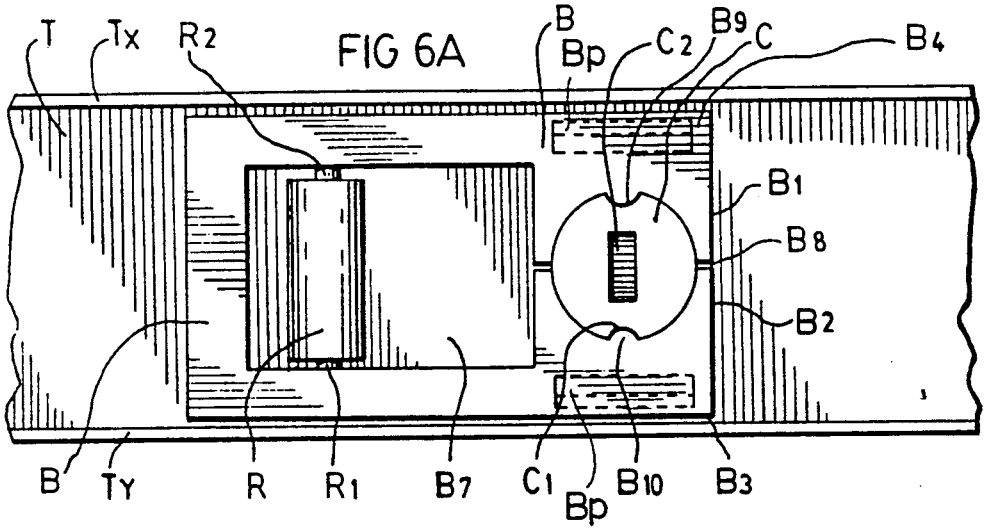
FIG. 6*a* and 6*b* are a schematic view of the carrier mechanism of FIG. 6, illustrating the operation thereof in a preferred embodiment of the invention.
Figure 6B:
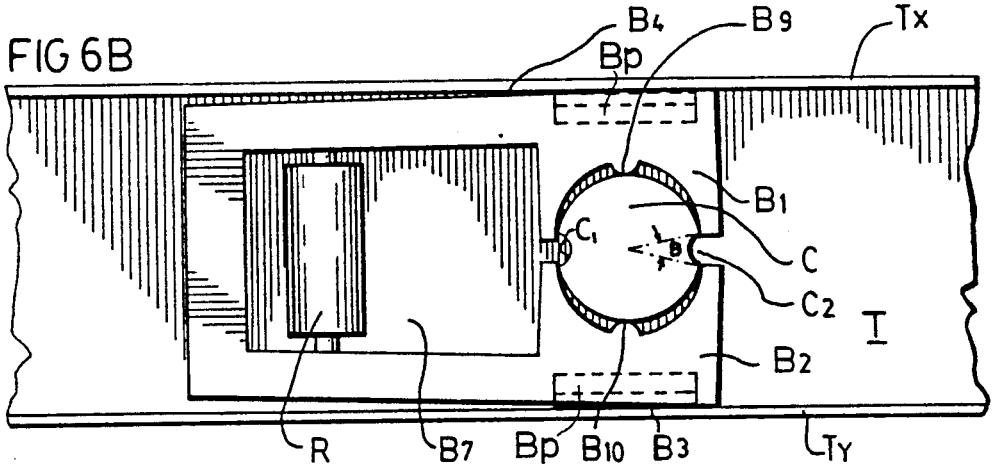
Figure 6C:
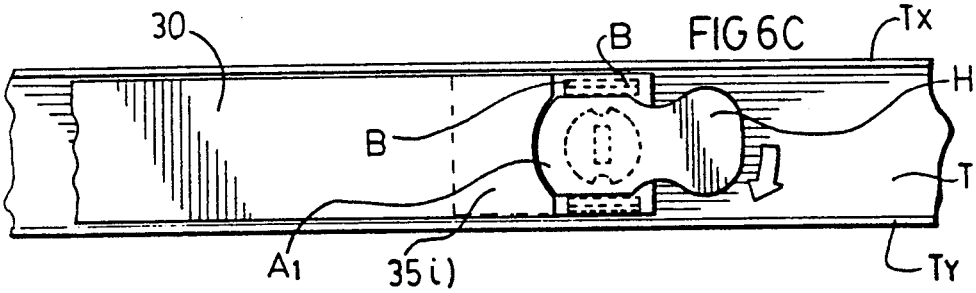
FIG. 6*c* and 6*d* are a schematic top view of the blocks as illustrated in FIGS. 6*a* and 6*b* incorporating a handle portion in another preferred embodiment of the invention.
Figure 6D:
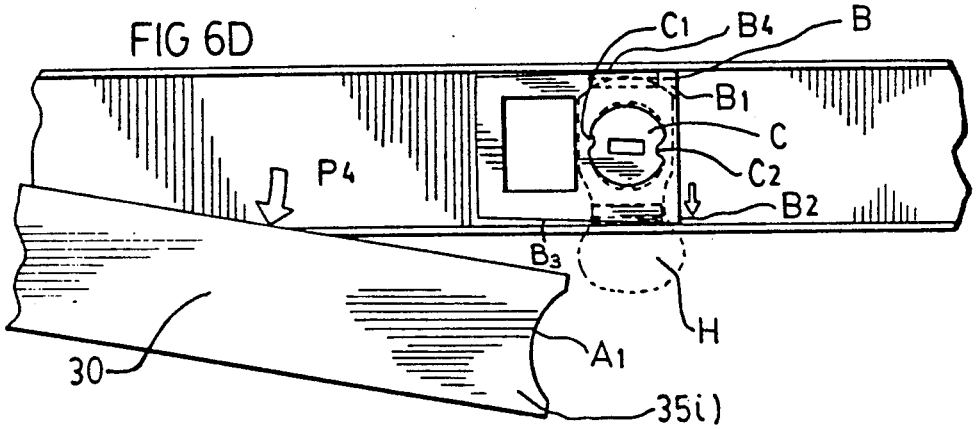

Referring now to FIGS. 6*a* through 6*d*, there is illustrated in schematic form the operation of a block B or carrier B located within a track T having lateral sidewalls Tx and Ty extending in a direction from top to bottom of the block B. For simplification purposes the main portions of the block B are illustrated, wherein a roller R is supported within openings formed in the carrier mechanism as illustrated in relation to FIGS. 5 and 6, the openings being slightly smaller at the bottom thereof than the diameter of the pins or tubular extension R1 and R2 in order to ensure a firm fit and in the preferred embodiment the openings having a bevelled shaped proximate the bottom of the carrier B and extending into an arcuate shape approximate the top, thus allowing the pins to be snugly secured within the arcuate opening thus allowing rotation of the roller R1 while providing for a snug fit prevented from being moved by the top bevelled portion of the opening being slightly narrower than the diameter of the pin. It is important that the roller be positioned so as to improve the sliding characteristics of the window and thus it must extend slightly below the carrier bottom. A cam C is located within the opening (not shown) bisected essentially by the slot B8. The cam having recesses within the perimeter thereof at C1 within which complementary beads B9 and B10 extend when the block or carrier is free to slide within the channel or tract T and when the slot C2 containing the pin or pivot (not illustrated) is in a position wherein the slot C2 extends towards the beads B9 and B10. However, as illustrated in FIGS. 6B, when the cam is rotated in the direction wherein the alignment of the recesses C1 and C2 of the cam C are no longer in alignment with the beads B9 and B10, then the leg portions B1 and B2 of the carrier B are forced laterally away from the slot B8 and thus engaging the sidewalls B4 and B3 against the inside surface of the track sidewalls Tx and Ty thus binding the block or carrier B from moving in any direction. The blocks illustrated in FIGS. 6*a* and 6*b* are those blocks which allow for the pivoting of the window or sash and allow for the almost immediate locking of the windows or sash when pivoted to its final resting position, whether the pivoting be slight or great. The pivoting of course, must be greater than an angle theta as illustrated in relation to FIG. 6*b* which is the angle or number of degrees within which the beads B9 will engage with the openings C2. It has been determined in a preferred embodiment that this angle is approximately 9° and thus in this embodiment if the window is pivoted for an angle of greater than 9° it will lock. In the past, windows have pivoted up to 26° without being locked and this has created problems for window hardware manufacturers in that the pivot pins may dislodge from the corresponding cam slots. By minimizing the amount of degrees of freedom for the pivoting of the window, the window is held in locked position for a greater amount of time with greater security. The beads B9 and B10 and the recesses C1 and C2 may be of significant size in order to cause the deflection of the legs B1 and B2 and yet of small enough size that the locking angle or degrees of freedom is kept to a minimum.

Referring now to FIGS. 6*c* and 6*d*, a specific advantage of the instant invention is illustrated incorporating the advantages of FIGS. 6*a* and 6*b* wherein a block is provided B at the end remote the pivot of the window sash, the bock being interconnected a best illustrated in relation to FIG. 7*a* with the block of the pivoting aspect. However, the block in FIG. 6*c* and 6*d* when interconnected with the block of FIG. 6*a* and 6*b* provides a tight and supportive bracing structure for the window sash when sliding as illustrated in FIG. 6*c*, wherein the sash portion 35*i* having an arcuate end portion A1 compatible with the arcuate end portion of the handle Ha prevents the window sash from pivoting but remains in a locked position to allow for the bracing and thus the uniform sliding of the sash within the tract T. However when the handle affixed to the cam via a pin (not shown) connected to slot C2 is rotated in a direction P3, it will as illustrated in relation to FIG. 6*b* cause the locking of the carrier B in position as the handle is rotated to the position illustrated in FIG. 6*d* while unlocking the window as the arcuate surfaces A1 and Ha are disjointed. The window sash 30 will then be free to rotate in a direction P4 and will be locked in position upon its pivot as illustrated in relation to FIGS. 6*a* and 6*b* while the bracing block is locked in position awaiting for the movement of the sash 30 back into locking engagement with the handle portion H. The bracing portion or block B prevent any movement of the pivot portion upon which the sash 30 is pivoting and thus prevents the dislodging of the pivot pin or the sagging of the window to any substantial extent. This is important so that the portion of the window proximate the arcuate portion A1 will not ride on the weather stripping disposed on the bottom portion of the sash 30. It has been found in the past that with other pivoting windows after a certain amount of time the weather stripping at the end remote the pivot begins to take a lot of abuse and the window begins to ride upon it. By providing a window structure which has a roller which further enhances the movement of the block and by providing a window structure which rides directly upon the blocks and not upon the weather stripping the integrity of the weather stripping is maintained for a greater period of time and the maintenance of the window is thereby reduced. This is clearly observed in relation to FIG. 7*b*.

Figure 7B:
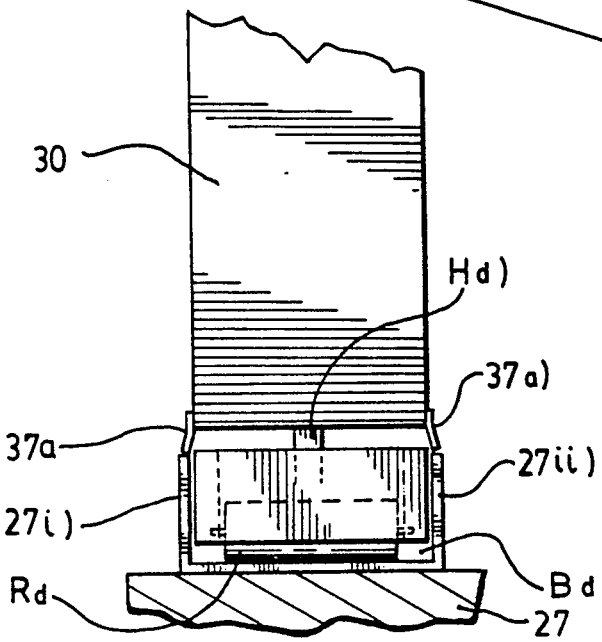
FIG. 7*b* is a close-up cut away end view of the carrier Bd illustrated in a preferred embodiment of the invention.

Referring now to FIG. 7*b*, the aspect described above is clearly illustrated, wherein the portion of the sash 30 being supported upon a pivot pin Hd1 and upon a block Bd riding upon a roller Rd within a channel attached to the sill framing portion 27 wherein members 27*i* and 27*ii* describe a channel within which the block Bd rides. The weather stripping 37*a* is clearly observed as a portion of the bottom of sash member 30 which rides upon the pivot pins Hd1, for example, leaving the weather stripping in a much more reliable state not found within the prior art.

Referring now to FIG. 7*a*, there is illustrated in exploded perspective view the window sash 30 being of generally rectangular form and having horizontally extending sections 32 and 37 and vertically extending portions 35. Disposed upon the top and bottom of sections 32 and 37 respectively are weather stripping portions 32*a* and 37*a* the use of which has already been herein described in relation to FIG. 7*b*. A pivot pin Cp1 and Cp2 are disposed at one end of the window assembly proximate the blocks Ba and Bc respectively. These pivot pins are substantially rectangular in shape and cooperate with the openings Ca2 and Cc2 found within the cams Ca and Cc respectively. Thus the interconnection between the sash and the pivot blocks are through the pivot pins Cp1 and Cp2. At the other end of the sash assembly and interconnected to the locks Ba and Bc are blocks Bb and Bd located at the top and bottom of the window sash respectively. The blocks Bb and Bd have pivot pins Hb1 and Hd1 extending into the cam openings Cb2 and Cd2 of cams Cb and Cd respectively. The handle portions Hb and Hd are connected to the pivot pins Hb1 and Hd1 respectively. The handle portions have arcuate portions Ha disposed remote the portion wherein an operator will grasp the handle.

The arcuate portions Ha extend into the arcuate portions of 35*i* disposed within the vertical sections 35 of the sash 30. Thus the arcuate portion Ha locks the window in position for sliding purposes only and prevents the pivoting thereof when the handle Hb and Hd extend in a line parallel to the extension of the length of the blocks Bb and Bd. Interconnecting the blocks Ba and Bb are two horizontally extending flat bars F1 and F2 interconnected at a fastening screw and nut V1 and V2 extending through an opening within the flat bar F2 and through a slot F6 of the flat bar F1. The slot of course, allows for the adjustability of the hardware when dealing with windows of alternative widths. It has been found that by providing standardized hardware and merely changing the distances which they are spread apart, the instant invention can apply to windows from 12 inches to windows of 48 inches and beyond. When windows of 48 inches and beyond are considered it is advantageous to provide more than two blocks of the essentially same characteristics as those found within FIG. 7*a* with the advantage that the additional blocks assist in the sliding of the window and in the bracing of the window, the blocks in the central portions being of essential neutral ability not incorporating pins in one embodiment, thereby serving only as a sliding aid. For purposes of illustration, the rollers have been left out of the description in relation to FIG. 7*a* as they were described clearly in relation to FIGS. 6*a* through 6*d*. The purpose of FIG. 7*a* is to illustrate the interconnection of the blocks.

Blocks Bc and Bd are interconnected in similar manner to the blocks Ba and Bb. Thus, a flat bar F3 and F4 are provided with a pin and nut arrangement V3 and V4 extending through an opening through the top of flat bar F4 and extending through a slot F5 within the flat bar F3 which again gives the adjustability of the distances between the blocks. Portions Ba11, Bb11, Bc11, and Bd11 (not shown) are provided within the blocks to allow for the interconnection of the flat bars F1, F2, F3, and F4 respectively which are fastened by a pin or alternative fasteners. It is important that the fastening be secure and the flat bar strong. Of course as is well known in the art, channels located upon the header and sill portions 22 and 27 are provided having a top and bottom 22*b* and 27*b* respectively and vertically extending sidewalls 22*i*, 22*ii*, 27*i* and 27*ii* respectively, having a surface 22*a* and 27*a* upon which the blocks will move upon the rollers.

Figure 8:
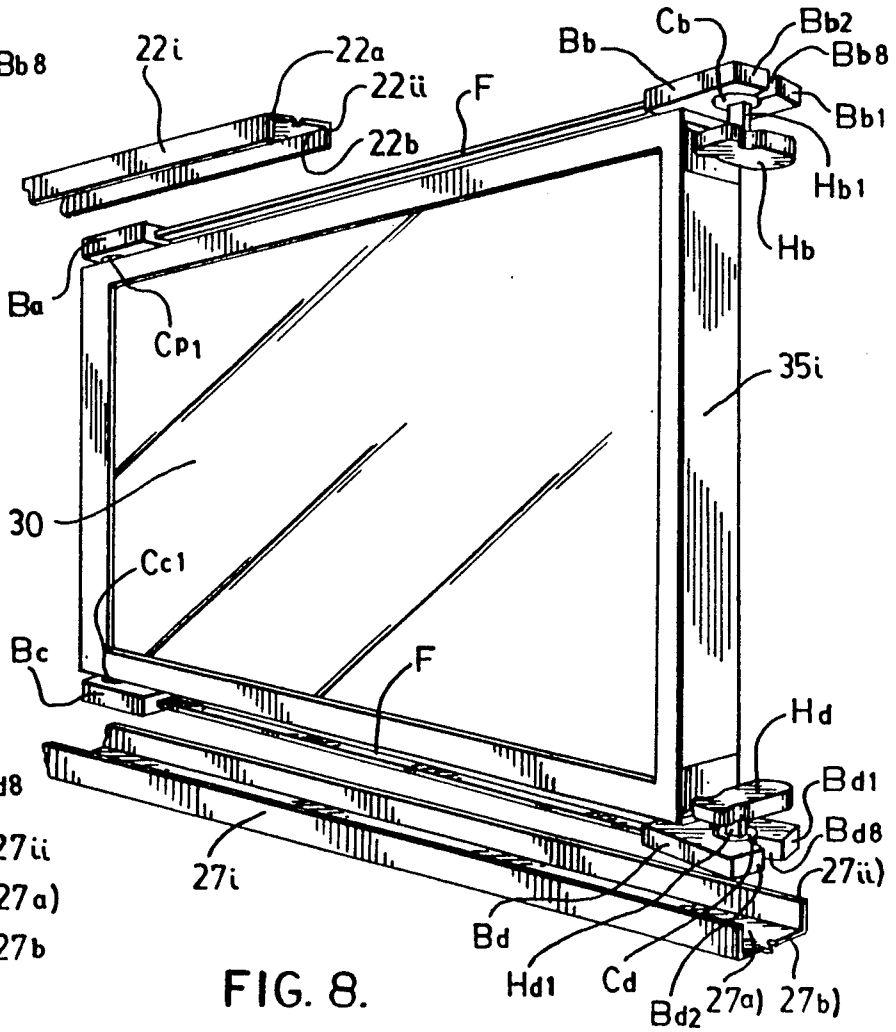
FIGS. 7*c*, 8 and 9 are partly exploded perspective views of the sash 30 of FIG. 7*a* illustrated in a sequence of events for sliding and tilting of the window in a preferred embodiment of the invention.
Figure 7C:
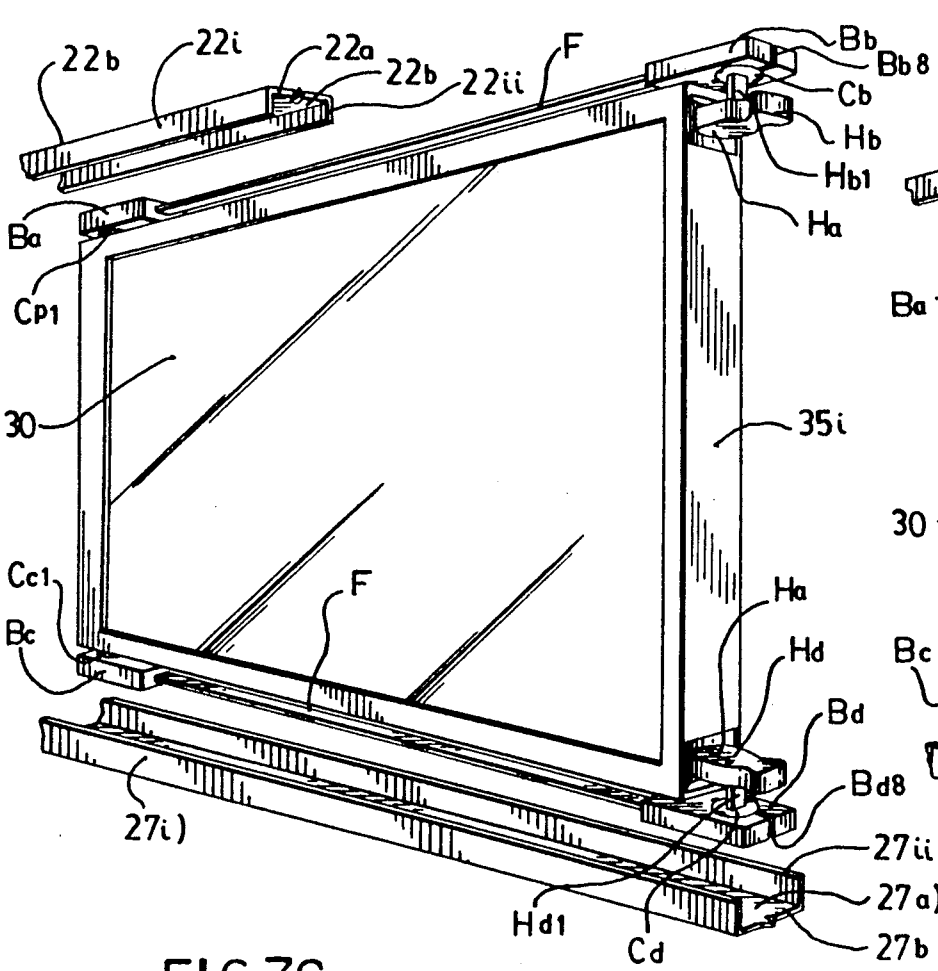
Figure 9:
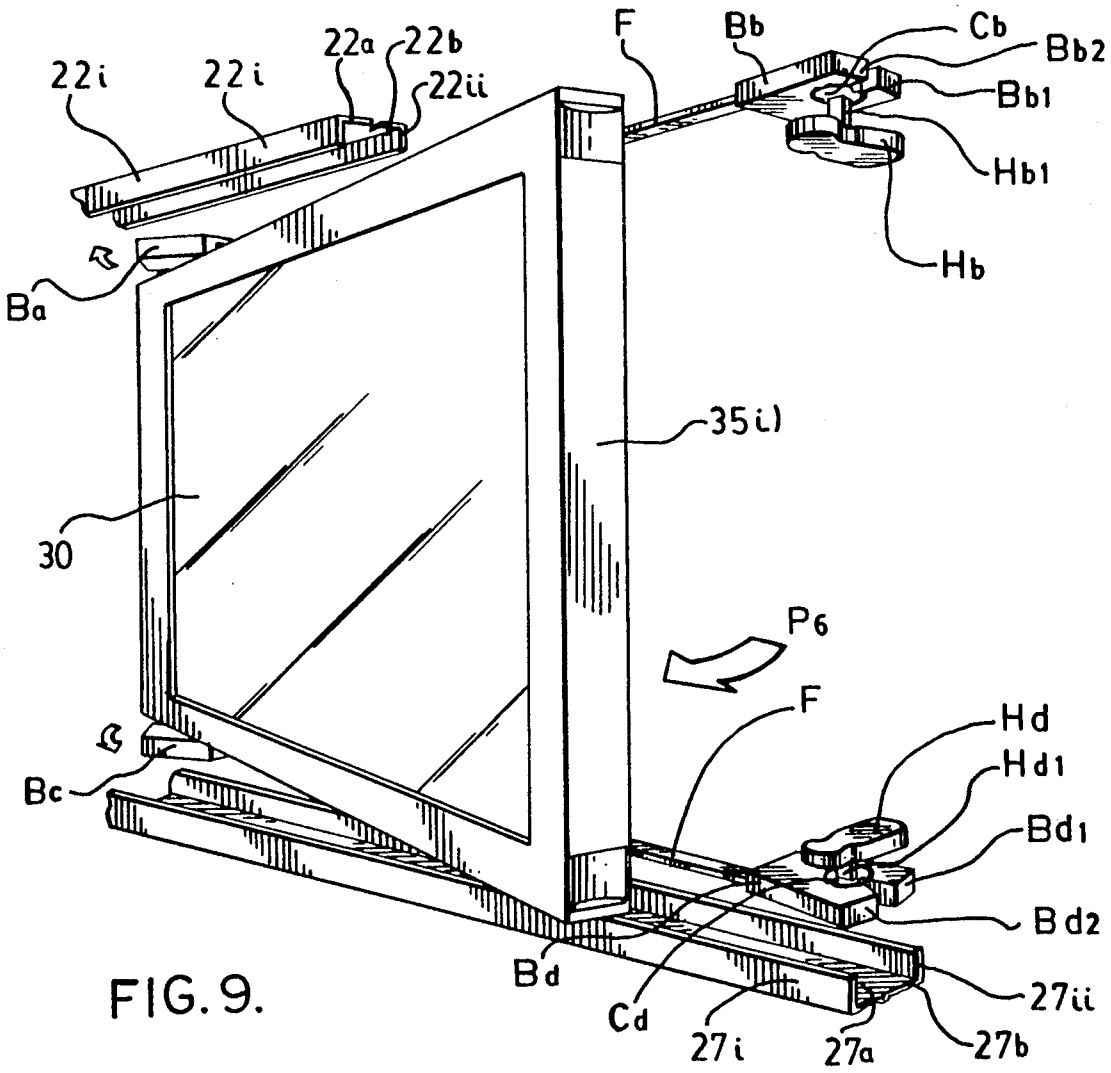

Referring now to FIGS. 7*c*, 8 and 9 there is illustrated a sequence of events which allows for the sliding of the window within the channels as illustrated in relation to FIG. 7*a* upon blocks Ba, Bb, Bc, and Bd respectively interconnected as illustrated in FIG. 7*a*. Thus, when the handle Hb and Hd are in a position such that the arcuate portions Ha are securely locked within the recess or arcuate portion 35*a* of the vertically extending section 35 of window sash 30, the window sash 30 is only able to slide along the channels 22*i* and 27*i* while the blocks and the pivot pins remain in position such that the openings within which the pivot pins are retained (which are emphasized for the purposes of illustration in relation to FIGS. 7*c*, 8, and 9) and allow for the movement of the window sash in slidable fashion only. However, as illustrated in FIG. 8, when the handles Hb and Hd are rotated in a direction such that the handles extend in a direction normal to the extension of the window, the blocks Bb and Bd will lock against the sidewalls 22*i*, 22*ii*, 27*i* and 27*ii* respectively preventing the movement of the blocks Ba and Bc in any slidable direction while the window sash 30 is free to pivot as illustrated in relation to FIG. 9, thus pivoting in a direction B6 and has been clearly described in relation to FIGS. 6*a* through 6*d*. When the window sash 30 begins to pivot the sidewalls of the blocks Ba and Bc will engage the sidewalls 27*i*, 27*ii*, 22*i* and 22*ii* respectively by the motion of the cam Ca, and Cc, in the direction such that the beaded portions of the carrier will cause the legs Ba1, Ba2, and Bc1, Bc2 to lock against the side rail portions preventing the movement of the window sash in a sliding direction and further as described above while ensuring the location of the blocks Bb and Bd when the window is pivoted back to its sliding position. By the blocks Ba and Bb being interconnected and the blocks Bc and Bd being interconnected, by the flat bar members, a firm bracing system has been provided which prevents the movement of the end of the window wherein the pivoting occurs proximate blocks Ba and Bc and prevents the pins Cp1, Cp1 from dislodging from the cam openings and further eliminates the need to anchor them in one embodiment of the invention. For safety sake to further enhance the stability of the hardware the fastener to the pin need not be eliminated but may be incorporated. However, the window will not sag, nor will the ends at which the windows pivot proximate the blocks Ba and Bc have a tendency to go out of parallel with the window frame. Nor will the weather stripping take a necessary load from the window as the window will be securely held in an upright position upon the pivots braced with the forward blocks or carriers Bb and Bd.

Thus the invention has provided a window assembly in a preferred embodiment which slides and pivots incorporating block mechanisms or carriers which allow for the sliding in cooperative fashion and pivoting in cooperative fashion, some of the pivots incorporating handle portions which lock the window in its sliding position and which unlock the window from its aligning position but simultaneously lock the pivoting block in position as a result by locking the handle block in position. Rollers have been provided to more uniformally advance the sliding of the window sash within the tracks or channels.

It is of course understood that the alternative embodiments of the invention would incorporate other closure members such as patio doors which would operate in identical manner to that described in relation to the figures of the vertical tilt slider illustrated in a preferred embodiment of the invention. However, the hardware provided would be more substantial in material but incorporate all of the design features illustrated in the drawings. It is intended that any tiltable and sliding closure device be construed as part of the invention and the invention is thus not limited to windows alone, but has broader application than described above Referring now to FIG. 10, there is illustrated the vertical tilt sliding window assembly of FIG. 1, illustrating the sash elements 30 and 40 being slidable within the tracks disposed within a frame Fr and being pivotable upon blocks B in direction D10 and D11 respectively, wherein the window glass 7 and 5 may be cleaned on both sides and pivoted back for sliding movement within the tracks upon frame Fr. The pivoting movement illustrated in relation to directions D10, and D11 simulate that of French doors and of course have broad application in the assembly of patio doors which normally only slide within a track assembly, by improving patio doors embodied in the invention described above using the hardware described above, a firm solid pivoting assembly is provided which allow for the appearance of French doors in many designs which may enhance the beauty of patio door and vertically disposed tilt sliding windows.

Figure 10:
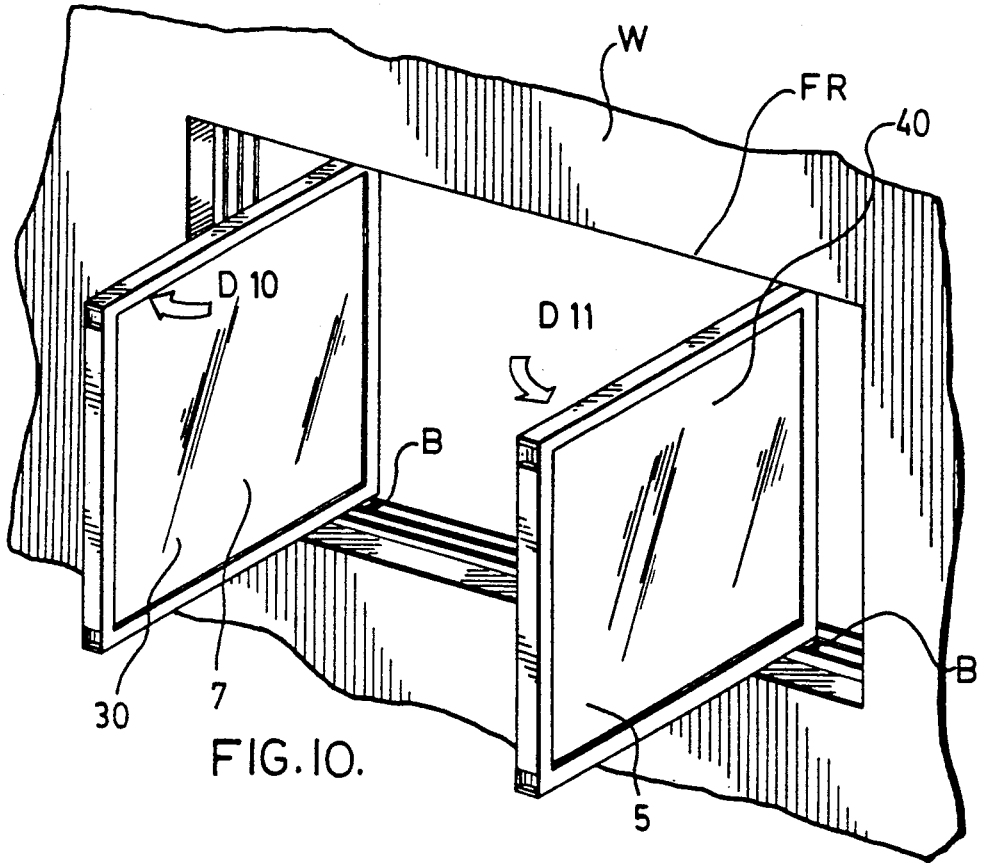
FIG. 10 is a perspective view of the window assembly of FIG. 1 as shown in a fully opened position in a preferred embodiment of the invention.
Figure 11:
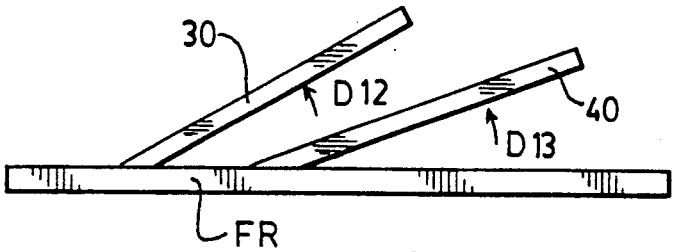
FIGS. 11, 12 and 13 are top schematic views of the layout of alternatively pivoting window sashes embodied within the window assembly of FIG. 1 in alternative embodiments of the invention.
Figure 12:
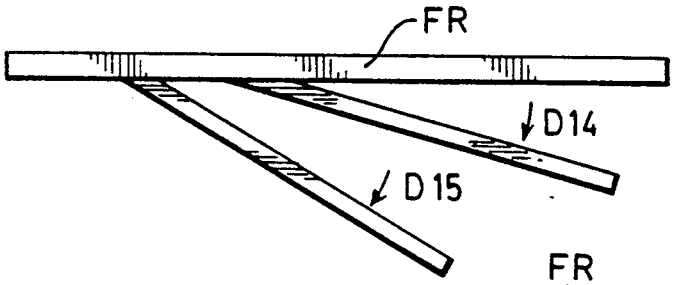
Figure 13:
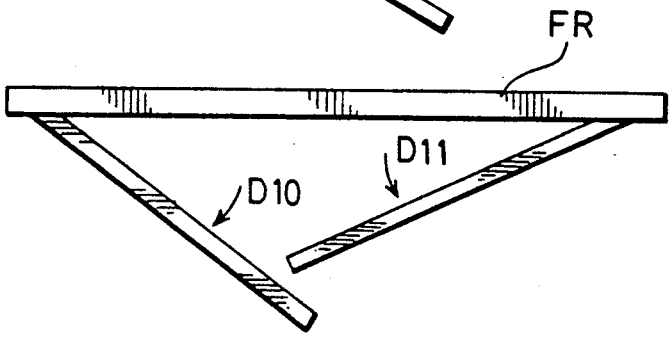

FIGS. 11, 12, and 13 describe only three alternative pivoting directions of the window sashes 30 and 40, that described in FIG. 13 being identical to that in FIG. 10. Thus the windows may be swung out in directions D12 and D13 or may be swung inward in directions D14, and D15. The design of the invention is to allow the greater flexibility for window manufacturers and to allow for a standardization of inventories. It is not important as to which extrusions are used for the framing sections. Further, it is not important as to what guide channels are provided. The invention may be applied to any window design and to any sash design providing the features described herein are incorporated into the design and that the shoe or carrier is dimensioned so as to ride within the guides or channels provided within each individual window design. The flat bars may come in one piece or in sections to allow for variation in the size of windows and it is at the present, determined that three sizes of hardware may be supplied to provide for all window sizes presently in the marketplace. However, this is not stated as a limiting aspect of the invention as any new development or unique window design may be incorporated and embodied with the unique hardware of the present invention.

In one embodiment illustrated in FIGS. 5, 6, 6A, 6B, 6C and 6D, the clamping surfaces B3, B4 include a braking surface Bp. The braking surface Bp includes metal inserts having a generally rectangular shape and having a pebbled surface. On the face of the clamping surfaces B3, and B4 there is a cut out or opening in which these inserts may be fastened. These inserts behave as brake pads and improve the performance of the entire system by ensuring a positive braking action much the same as brake shoes of an automobile.

As many changes can be made to the preferred embodiments of the invention without departing from the scope or intent thereof; it is intended that all matter contained herein be considered as illustrative of the invention and not in a limiting sense.

The embodiments of the invention in which an exclusive property or privilege is claimed are as follows:

1. A pivoting and sliding closure assembly comprising:

i) an opening extending in a peripheral frame said peripheral frame including a header portion, a sill portion and two vertically extending jamb portions ii) the sill and header portions or the two jamb portions having disposed therein or attached thereto track portions extending in a substantially parallel direction to the extensions of said peripheral frame portions ii) a) at least one closure member slidable within said track portions and pivotable proximate at least one end thereof, and latchable proximate the other end thereof iii) each track portions having disposed therein at least two pivot shoes being interconnected by interconnecting means, each pivot shoe including a carrier portion, the carrier portion further having interconnecting portions therewith to interconnect with the interconnecting means, some of the carrier portions having disposed therein an opening wherein camming means are disposed, said camming means being moveable to cause locking means disposed with said pivot shoe to engage and lock the pivot shoe from sliding movement in the track portions iv) some of the camming means of some of the pivot shoes having engagement means therewith for engagement with pivot means of the at least one closure member to allow the at least one closure member to rotate when free to do so and upon rotation thereof to cause the camming means to rotate thus locking the locking means of the pivot shoe v) some of the camming means of some of pivot shoes having latching means engaged therewith for latching the at least one closure member having latch engaging means therewith to prevent the closure member from pivoting upon its pivot means when the closure member remains slidable with said track and which when disengaged locks the pivot shoe in position with respect to the track by engaging the locking means thereof vi) the at least one closure member being braced from sagging by the interconnecting means interconnecting the pivot shoes disposed in each track, the interconnecting means further preventing the pivot means from disengaging from the relevant pivot shoe when the at least one closure member is rotated to an open position.

2. A pivoting and sliding window assembly comprising:

i) an opening extending in a peripheral frame said peripheral frame including a header portion, a sill portion and two vertically extending jamb portions ii) the sill and header portions or the two jamb portions having disposed therein or attached thereto track portions extending in a substantially parallel direction to the extensions of said peripheral frame portions ii) a) at least one window sash slidable within said track portions and pivotable proximate at least one end thereof and latchable proximate the other end thereof iii) each track portions having disposed therein at least two pivot shoes being interconnect by interconnecting means, each pivot shoe including a carrier portion, the carrier further having interconnecting portions therewith to interconnect with the interconnecting means, some of the carrier portions having disposed therein an opening wherein camming means are disposed, said camming means being moveable to cause locking means disposed with said pivot shoe to engage and lock the pivot shoe from sliding movement in the track portions iv) some of the camming means of some of the pivot shoes having engagement means therewith for engagement with pivot means of the at least one window sash to allow the at least one window sash to rotate when free to do so and upon rotation thereof to cause the camming means to rotate thus locking the locking means of the pivot shoe v) some of the camming means of some of pivot shoes having latching means engaged therewith for latching the window sash having latch engaging means therewith to prevent the at least one window sash from pivoting upon its pivot means when the closure member remains slidable with said track and which when disengaged locks the pivot shoe in position with respect to the track by engaging the locking means thereof vi) the at least one window sash being braced from sagging by the interconnecting means interconnecting the pivot shoes disposed in each track, the interconnecting means further preventing the pivot means from disengaging from the relevant pivot shoe when the window sash is rotated to an open position.

3. The assembly of claim 1 or 2, further comprising the carrier having rolling means disposed therein for assisting the movement of the pivot shoe, wherein roller means further comprises at least one roller having a central axis and having mounting pins extending from the ends thereof preferably for insertion within an opening within said body proximate the bottom thereof, the opening for said mounting pins being tapered from bottom to top wherein the narrowed portion is of less width than the diameter of the mounting pins, the narrow taper having an arcuate portion above it to retain the mounting pins in position in use.

4. The assembly of claim 1 or 2, wherein interconnecting means are lockable in relation to said carrier.

5. The assembly of claim 1 or 2, wherein the cam member further comprises recesses upon the surface thereof in alignment with beads upon the perimeter of the opening of the slot of the rectangular body, whereby the recesses and beads when aligned allow sliding movement of the shoe, wherein when not aligned cause the legs to move and cause the locking surfaces to engage the flanges of the guide channel.

6. The assembly of claim 1 or 2, wherein the assembly further comprises patio doors.

7. The assembly of claim 1 or 2, further comprising the carrier having rolling means disposed therein for assisting the movement of the pivot shoe.

8. The assembly of claim 1 or 2, wherein the locking means of the carrier of the pivot shoe further comprises braking surfaces affixed to the pivot shoe to engage the track portions of the closure assembly.

9. The assembly of claim 8, wherein the braking surfaces further comprises inserts having pebbled surfaces.

10. The assembly of claim 9, wherein the inserts are made from metal.

11. For use in a pivoting and sliding closure assembly, a closure member slidable within a guiding channel having outwardly extending flanges and pivotable therefrom, the closure member having a substantially rectangular frame having a top and bottom, and having engaged at its top and bottom proximate one end pivot means for engaging a first and second pivot shoe, and having disposed proximate the other end thereof proximate the top and bottom means for engaging a third and fourth pivot shoe, said pivot shoes slidable in said guiding channel and comprising a body having a top and bottom and having disposed proximate the bottom thereof at least one roller or wheel, said pivot shoes having disposed proximate one end thereof fastening means to fasten at least the first and third, and the second and fourth pivot shoes together by connecting means extending therebetween, each pivot shoe having a slot disposed proximate the end thereof remote the fastening means, said slot including an opening therein for a cam member, said slot and opening extending from proximate the top to proximate the bottom of said pivot shoe, said cam member being substantially cylindrical having a central axis and having camming means thereupon or upon the perimeter of the opening of said slot wherein a detent extends with said cam for engagement with the pivot means connected to the closure member for the first and second pivot shoe and a handle member for the third and fourth pivot shoe, said handle member having engagement means thereupon for engagement with the means for engaging the third and fourth pivot shoe of the closure member, the body having two legs, one on each side of the slot, having a clamping surface upon the surface of the body adjacent the outwardly extending flanges of the guide channel;

whereby when the handle member of the third and fourth pivot shoes are rotated the pivot means and the cam member rotate, and the two legs of the body move laterally away from the cam member urged by the camming means, the clamping surface thus engages the outwardly extending flanges of the guide channel thus locking the third and fourth pivot shoes in position in relation to said first and second pivot shoes, however rotation of the handle member disengages the means for engaging the third and fourth pivot shoes and the closure member, allowing the pivoting of the closure member upon the first and second pivot shoes upon the pivot means away from the guide channel, the closure member when pivoted causes the cam member of the first and second pivot shoe to rotate wherein the first and second pivot shoes are locked in position in the guide channel in identical manner to the third and fourth pivot shoe further prevented from movement under the weight of the closure member by the third and fourth pivot shoes locked and interconnected to the first and second pivot shoes.

12. The closure member of claim 11, wherein said closure member is a window sash.

13. The member of claim 11 or 12, wherein pivot shoes are made from thermoplastic material.

14. The closure member of claim 11 or 12, wherein the interconnecting means are adjustable in length.

15. The member of claim 11 or 12 further comprising the weather stripping portions extending from the top and bottom thereof.

16. The closure member of claim 11 or 12, wherein the cam member further comprises locking means to lock the pivot means within the cam opening.

17. The assembly of claim 11 or 12, wherein the cam member further comprises recesses upon the surface thereof in alignment with beads upon the perimeter of the opening of the slot of the rectangular body, whereby the recesses and beads when aligned allow sliding movement of the shoe, wherein when not aligned cause the legs to move and cause the locking surfaces to engage the flanges of the guide channel.

18. The assembly of claim 11 or 12, wherein the assembly further comprises patio doors.

19. The member of claim 11 or 12, wherein the handles further comprise keyed locking means.

20. A pivot shoe for connection to a pivotable and slidable closure member is provided for movement in a guiding channel having outwardly extending flanges, the pivot shoe comprising a body having top and bottom and two ends, said body having disposed at one end thereof an opening being generally cylindrical in shape, the body having disposed upon the perimeter of the opening at least one bead extending towards the center of the opening, the opening having a cam member disposed therein engageable with the closure member and having disposed upon its perimeter at least one recess compatibly shaped with and for engagement with the at least one bead of the opening, the cam for engaging clamping means disposed with said pivot shoe for clamping against the outwardly extending flanges of the guide channel when at least one recess of the cam moves from a position wherein it is aligned with the at least one bead of the body disposed proximate said opening, to a position wherein it is not aligned with said bead, wherein the pivot shoe further comprises roller means to improve the sliding movement thereof in the guiding channel.

21. The pivot shoe of claim 20, wherein each pivot shoe may further comprise fastening means to fasten more than one pivot shoes together, wherein preferably each body having an opening on the top thereof remote the cam for accepting a screw fastener, and preferably the fastening means being adjustable.

22. The shoe of claim 21, wherein the pivot shoe further comprises clamping means extending wherein the clamping means are two legs of the body proximate the opening created by a slot extending from proximate the top to proximate the bottom of the body and substantially bisecting the openings, each leg by movable into clamping engagement with the outwardly extending flanges of the guiding channel when the cam is pivoted.

23. The assembly of claim 20, wherein the assembly further comprises third and fourth pivot blocks whose handles extend in a substantially horizontal direction from the extension of the vertical extending pivot pins when the guide channel in which the first and third pivot shoe and the guide channel in which the second and fourth pivot shoes are vertically displaced a predetermined amount to allow pivoting of the window.

24. The pivot shoe of claim 20, wherein the closure member is a window sash.

25. The pivot shoe of claim 20 or 24, wherein the pivot shoe is formed from thermoplastic material.

26. The shoe of claim 20, wherein the pivot shoe further comprises clamping means extending wherein the clamping means are two legs of the body proximate the opening created by a slot extending from proximate the top to proximate the bottom of the body and substantially bisecting the openings, each leg by movable into clamping engagement with the outwardly extending flanges of the guiding channel when the cam is pivoted.

27. A pivot assembly for use with a pivoting and sliding closure assembly disposed in an opening, the closure assembly including a peripheral frame said peripheral frame including a header portion, a sill portion and two substantially vertically extending jamb portions, the sill and header portions or the two jamb portions having disposed therein or attached thereto track portions, the closure assembly having at least one closure member slidable within said track portions and pivotable about an axis at one end of the closure member and latchable at the other end of the closure member, the pivot assembly comprising at least two pivot shoes being interconnected by interconnecting means and disposed in the track portions of the closure assembly in use, each pivot shoe including a carrier portion having a top and bottom, the carrier portion further having interconnecting portions therein to interconnect with the interconnecting means, the carrier portion having disposed therein an opening extending from top to bottom wherein camming means are disposed, said camming means being moveable to cause locking means disposed with said pivot shoe to engage and lock the pivot shoe against sliding movement in the track portions of the closure assembly in use;

i) some of the camming means of some of the pivot shoes having engagement means therein for engaging a pivot means of the at least one closure member of the closure assembly in use to allow the at least one closure member of the closure assembly to pivot causing the camming means to rotate thus locking the locking means of the pivot shoe;

ii) some of the camming means of some of pivot shoes having latching means for latching the at least one closure member of the closure assembly, and having a latch engaging means for preventing the closure member from pivoting upon its pivot means when the closure member is slidable with said track and which when disengaged locks the pivot shoe in position with respect to the track by engaging the locking means thereof;

the at least one closure member of the closure assembly being braced from sagging by the pivot assembly, the interconnecting means of the pivot assembly interconnecting the pivot shoes disposed in the track of the closure assembly, the interconnecting means further preventing the pivot means from disengaging from the engagement means when the at least one closure member of the closure assembly is rotated to an open position in use.

28. A pivot assembly for use with a pivoting and sliding window assembly disposed in an opening, the window assembly including a peripheral frame, said peripheral frame including a header portion, a sill portion and two vertically extending jamb portions, the sill and header portions or the two jamb portions of the window assembly having disposed therein or attached thereto track portions, the window assembly having at least one window sash slidable within said track portions and pivotable about an axis at one end of said sash and latchable at the other end of said sash;

the pivot assembly comprising at least two pivot shoes disposed in the track portions of the window assembly, and said shoes being interconnected by interconnecting means, each pivot shoe including a carrier portion having a top and bottom, the carrier portion further having interconnecting portions therein to interconnect with the interconnecting means, the carrier portion having disposed therein an opening extending from top to bottom wherein camming means are disposed, said camming means being moveable to cause a locking means disposed with said pivot shoe to engage and lock the pivot shoe against sliding movement in track portions of the window assembly;

i) some of the camming means of some of the pivot shoes having engagement means therein for engaging a pivot means of the at least one window sash of the window assembly in use to allow the at least one window sash to pivot causing the camming means to rotate thus locking the locking means of the pivot shoe;

ii) some of the camming means of some of the pivot shoes having latching means for latching the window sash of the window assembly in use, and having a latch engaging means preventing the at least one window sash from pivoting upon its pivot means when the at least one window sash is slidable with said track and which when disengaged locks the pivot shoe in position with respect to the track by engaging the locking means thereof;

the at least one window sash of the window assembly in use being braced from sagging by the pivot assembly, the interconnecting means of the pivot assembly interconnecting the pivot shoes disposed in the track, the interconnecting means further preventing the sash pivot means from disengaging from the engagement means when the window sash is rotated to an open position.

29. The pivot assembly of claim 27 or 28 wherein the carrier has rolling means disposed therein for assisting the movement of the pivot shoe wherein the roller means further comprises at least one roller having a central axis and having mounting pins extending from the ends thereof inserted within an opening within said carrier portion, the opening for said mounting pins being tapered from bottom to top wherein the narrowed portion is of less width than the diameter of the mounting pins, the narrow taper having an arcuate portion above it to retain the mounting pins in position is use.

30. The pivot assembly of claim 27 or 28, further comprising a carrier having rolling means disposed therewith for assisting the movement of a pivot shoe.

31. A pivot assembly for use with a pivoting and sliding closure assembly disposed in an opening and including a peripheral frame, said peripheral frame including a header portion, a sill portion and two vertically extending jamb portions, the sill and header portions or the two jamb portions having disposed therein or attached thereto track portions, the closure assembly having at least one closure member slidable within said track portions and pivotable at one end of the closure member and latchable at the other end of the closure member;

the pivot assembly comprising at least two pivot shoes disposed in the track portions of the closure assembly and being interconnected by the interconnecting means, each pivot shoe including a carrier portion having a top and bottom, the carrier further having interconnecting portions therein to interconnect with the interconnecting means, the carrier portion having disposed therein an opening extending from top to bottom wherein camming means are disposed, said camming means being moveable to cause locking means disposed with said pivot shoe to engage and lock the pivot shoe against sliding movement in the track portions of the closure assembly in use;

i) some of the camming means of some of the pivot shoes having engagement means therein for engaging a pivot means of the at least one closure member of the closure assembly in use to allow the at least one closure member to pivot causing the camming means to rotate thus locking the locking means of the pivot shoe;

ii) some of the camming means of some of the pivot shoes having latching means to latching the at least one closure member of the closure assembly, and having a latch engaging means for preventing the closure member from pivoting upon its pivot means when the closure member is slidable with said track and which when disengaged locks the pivot shoe in position with respect to the track by engaging the locking means thereof;

the at least one closure member of the closure assembly in use being braced from sagging by the pivot assembly, the interconnecting means of the pivot assembly interconnecting the pivot shoes disposed in the track, the interconnecting means further preventing the closure pivot means from disengaging from the engaging means when the at least one closure member is rotated to an open position.

32. A pivot assembly for use with a pivoting and sliding window assembly disposed in an opening including a peripheral frame, said peripheral frame including a header portion, a sill portion and two vertically extending jamb portions, the sill and header portions or the two jamb portions having disposed therein or attached thereto track portions, the window assembly having at least one window sash slidable within said track portions and pivotable at one end of said sash and latchable at the other end of said sash;

the pivot assembly comprising at least two pivot shoes disposed with the track portions, said shoes being interconnect by interconnecting means, each pivot shoe including a carrier portion having a top and bottom, the carrier having interconnecting portions therein to interconnect with the interconnecting means, the carrier portion having disposed therein an opening extending from top to bottom wherein camming means are disposed, said camming means being moveable to cause a locking means disposed with said pivot shoe to engage and lock the pivot shoe against sliding movement with the track portions iv) some of the camming means of some of the pivot shoes having engagement means therein for engaging a pivot means of the at least one window sash in use to allow the at least one window sash to pivot causing the camming means to rotate thus locking the locking means of the pivot shoe v) some of the camming means of some of said the pivot shoes having latching means for latching the window sash to prevent the at least one window sash from pivoting upon its pivot means when the window sash remains slidable with said track and which when disengaged locks the pivot shoe in position with respect to the track by engaging the locking means thereof vi) the at least one window sash being braced from sagging by the interconnecting means interconnecting the pivot shoes, the interconnecting means further preventing the pivot means from disengaging from the relevant pivot shoe when the window sash is rotated to an open position.

33. A pivot assembly for use with a pivoting and sliding closure assembly having a guiding channel having outwardly extending flanges, and having a closure member slidable in said channel and pivotable therefrom, the closure member having a substantially rectangular frame having a top and bottom, said closure member having pivot pins proximate the top and bottom at one end thereof engaging a first and a second pivot shoe, and having closure member means disposed at the other end thereof proximate its top and bottom for engaging a third and fourth pivot shoe, the pivot assembly comprising the first, second, third, and fourth pivot shoes, each pivot shoe being slidable in said guiding channel of the closure assembly and having a generally rectangular body having a top and bottom and having disposed proximate the bottom thereof at least one roller or wheel, said pivot shoes having fastening means to fasten the first and third, and the second and fourth pivot shoes together by connecting means extending therebetween, each pivot shoe having a slot including a opening therein for a cam member, said slot and opening extending from proximate the top to proximate the bottom of said pivot shoe, a cam member in said opening being substantially cylindrical having a central axis and having camming means thereupon or upon the perimeter of the opening of said slot, wherein a slot extends into said cam in use for insertion of the pivot pins of the closure member of the closure assembly in the first and second pivot shoe and for insertion of a pivot means of a handle member in the third and fourth pivot shoe, said handle member having engagement means thereupon for engagement of the closure member means with the third and fourth pivot shoe, the rectangular body of each shoe having two legs, one on each side of the opening, having a clamping surface upon the surface of the rectangular body adjacent the outwardly extending flanges of the guide channel of the closure assembly in use;

whereby when the handle members of the third and fourth pivot shoes are rotated the pivot pin and the cam member rotate, and the two legs of the rectangular body move laterally away from the cam member urged by the camming means, in use the clamping surface thus engages the outwardly extending flanges of the guide channel of the closure assembly thus locking the third and fourth pivot shoes in position in relation to the guide channel, the rotation of the handle member disengages the means for engaging the third and fourth pivot shoes and the closure member of the closure assembly, allowing the pivoting of the closure member upon the camming means of the first and second pivot shoes away from the guide channel of the closure assembly, the closure member when pivoted causing the cam member of the first and second pivot shoe to rotate and the first and second pivot shoe are locked in position in the guide channel of the closure assembly in identical manner to the third and fourth pivot shoe further preventing movement.

34. A pivot shoe having connecting means for connection to a pivotable and slidable closure member and movement means for movement in a guiding channel having outwardly extending flanges, the pivot shoe comprising a body having top and bottom and two ends, said body having disposed therewith an opening, the body having disposed upon the perimeter of the opening at least one cam follower means, the opening having a rotatable cam member disposed therein engaging the closure member and having disposed upon its perimeter camming means for engagement with the at least one cam follower means upon rotation of the cam member, in use the cam member rotation also engaging and moving a clamping means disposed with said pivot show to a clamping position against the outwardly extending flanges of the guide channel of the closure assembly when the camming means disposed with the cam is disengaged from the at least one cam follower means of the body, said cam member rotating from a position wherein the camming means is engaged with the at least one cam follower and said clamping means is disengaged from said flanges, wherein the pivot shoe further comprises roller means to improve the sliding movement thereof in the guiding channel.

35. The pivot shoe of claim 38 further comprising fastening means to fasten more than one pivot shoes together, wherein each body has means therewith for accepting fastening means to fasten the pivot shoes together.

36. The shoe of claim 35 wherein the clamping means are two legs of the body proximate the opening created by a slot extending from proximate the top to proximate the bottom of the body and substantially bisecting the openings, each leg by movable into clamping engagement with the outwardly extending flanges of the guiding channel when the cam is pivoted.

37. The assembly of claim 34 wherein the roller means further comprises at least one roller having a central axis and having mounting pins extending from the ends thereof for insertion within an opening within said body proximate the bottom thereof, the opening for said mounting pins being tapered from bottom to top wherein the narrowed portion is of less width than the diameter of the mounting pins, the narrow taper having an arcuate portion above it to retain the mounting pins in position in use.

38. The shoe of claim 34 wherein the clamping means are two legs of the body proximate the opening created by a slot extending from proximate the top to proximate the bottom of the body and substantially bisecting the openings, each leg by movable into clamping engagement with the outwardly extending flanges of the guiding channel when the cam is pivoted.

* * * * *